US007337787B2

(12) United States Patent
Matsuoka

(10) Patent No.: US 7,337,787 B2
(45) Date of Patent: Mar. 4, 2008

(54) CONTAINER FOR MAKE-UP POWDER

(75) Inventor: Kazuo Matsuoka, Tokyo (JP)

(73) Assignee: Katsushika Co. Ltd., Tokyo (JP)

( * ) Notice: Subject to any disclaimer, the term of this patent is extended or adjusted under 35 U.S.C. 154(b) by 241 days.

(21) Appl. No.: 10/872,410

(22) Filed: Jun. 22, 2004

(65) Prior Publication Data

US 2005/0109363 A1 May 26, 2005

(30) Foreign Application Priority Data

Jun. 23, 2003 (JP) ..... 2003-177596

(51) Int. Cl.
*A45D 33/02* (2006.01)

(52) U.S. Cl. ..... 132/307

(58) Field of Classification Search ..... 132/293–298, 132/305, 306, 307, 299
See application file for complete search history.

(56) References Cited

U.S. PATENT DOCUMENTS 1,616,381 A * 2/1927 MacDougall ..... 132/298
1,794,602 A 3/1931 Friedman
1,814,748 A 7/1931 Friedman
1,855,399 A * 4/1932 Klotz ..... 132/295
1,903,357 A 4/1933 Friedman

FOREIGN PATENT DOCUMENTS

JP 07-16708 3/1995
JP 08-131248 5/1996

* cited by examiner

*Primary Examiner*—Robyn Doan
(74) *Attorney, Agent, or Firm*—Westerman, Hattori, Daniels & Adrian, LLP.

(57) ABSTRACT

A container for storing make-up powder, such as white powder or powder foundation and an application member such as a powder puff includes a structure wherein a make-up material-storing compartment for storing make-up powder has an intermediate lid which is engaged with a container. At least a part of a partition portion of the intermediate lid is formed with an elastic material, with numerous small cuts vertically formed through the partition portion, thereby enabling make-up powder to pass through the small cuts opened by extending the partition portion. The small cuts are arranged in a direction crossing a direction of extension of the partition portion under a normal use condition.

1 Claim, 5 Drawing Sheets

CONTAINER FOR MAKE-UP POWDER

FIELD OF THE INVENTION

In a container storing make-up powder such as white powder or powder foundation and an application member such as a powder puff, the present invention relates to an improvement of a container for make-up powder which prevents scattering a make-up material inside the container or therearound.

BACKGROUND OF THE INVENTION

In the past, many containers have been reported which store make-up powder such as white powder or powder foundation as is in powder form and store thereon an application member such as a puff having a long pile called a powder puff. Many of these containers have a structure where an intermediate lid covers make-up powder, and an application member is placed on the intermediate lid. The intermediate lid has numerous pores formed downward therethrough. When in use, make-up powder is applied with an application member to which the make-up powder adheres through the pores.

However, due to vibration while carrying it, make-up powder moves through the pores to a compartment for storing an application member, and there is an occasion where the application member is covered fully with the make-up powder. Although this problem can be solved by providing a mechanism of closing the pores of the intermediate lid while carrying it, it becomes a problem because it is necessary to provide a mechanism of opening the pores of the intermediate lid, which leads to a cost increase due to an increase in the number of parts. Further, recently, in view of adhesion, masking degree, and feeling upon application of a make-up material, ultra fine particle type make-up powder which is more highly pulverized power has been provided. This ultra fine particle type make-up powder tends to move to an application member-storing compartment, and consequently, make-up powder in the application member-storing compartment tends to be dispersed outside due to air flow caused when a lid of a container opens.

SUMMARY OF THE INVENTION

In view of the above, in the present invention, at least a part of a partition portion 16*a* of an intermediate lid 8*a* is constituted by an elastic material; numerous small cuts 117 are formed in the partition portion 16*a*; when no load is applied (not in use), the small cuts 117 are closed, thereby closing a make-up material compartment 33; when a load is applied (in use), the partition portion 16*a* is stretched, thereby opening the small cuts 117 and enabling the make-up powder 1 to pass through the small cuts 117 and to be usable; and whereby the make-up powder 1 can adhere to the application member 31*a*.

In a structure where a make-up material-storing compartment 33 storing make-up powder 1 such as white powder or powder foundation is constituted under an intermediate lid 8*a* which is engaged with a container 6, at least a part of a partition portion 16*a* of said intermediate lid 8*a* constituting the make-up material-storing compartment 33 is formed with an elastic material, numerous small cuts 117 through the partition portion 16*a* vertically are formed, thereby enabling make-up powder 1 to pass through the small cuts 117 opened by extending the partition portion 16*a*. These small cuts 117 are arranged in a direction crossing a direction of extension of the partition portion 16*a* under a normal use condition.

DETAILED DESCRIPTION OF THE INVENTION

Figure 1:
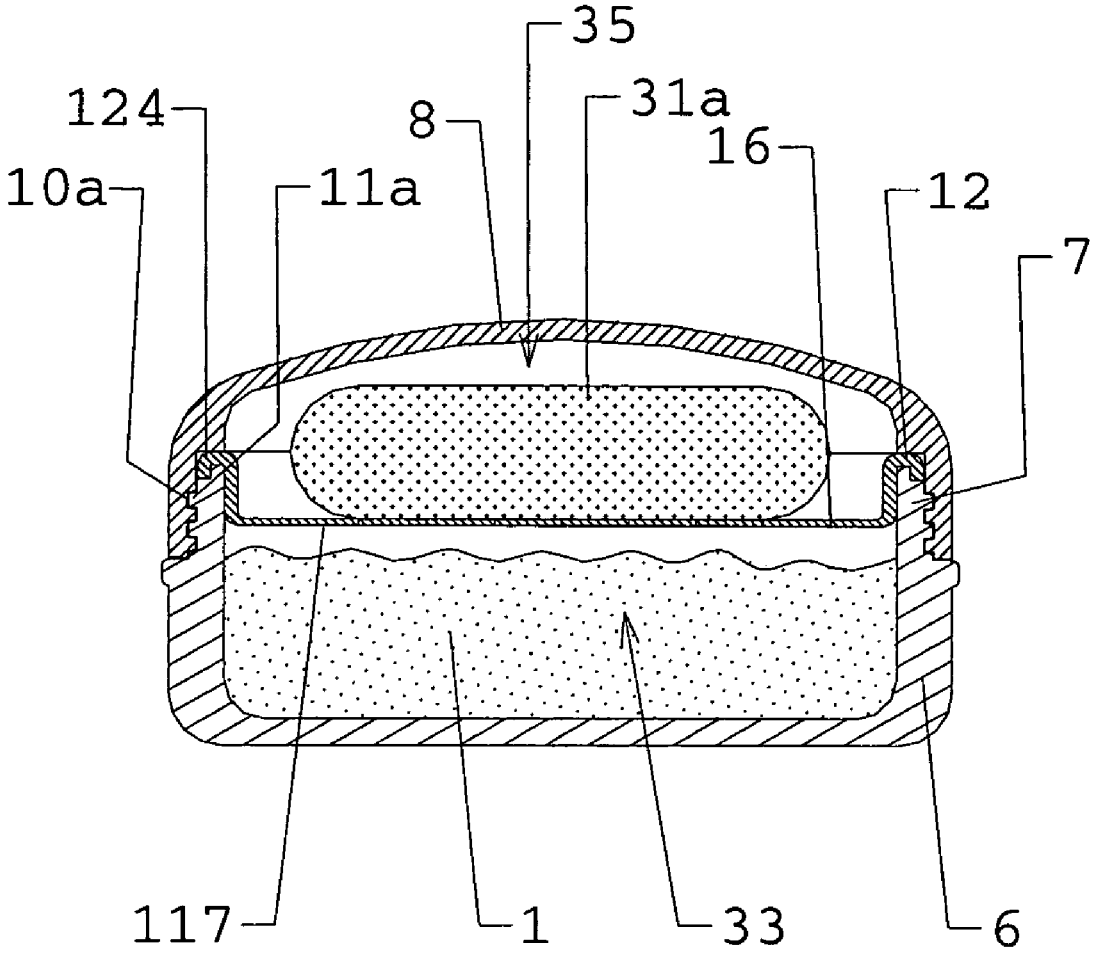
FIG. 1 is a front cross sectional view of the container for make-up powder according to an example of the present invention.
Figure 2:
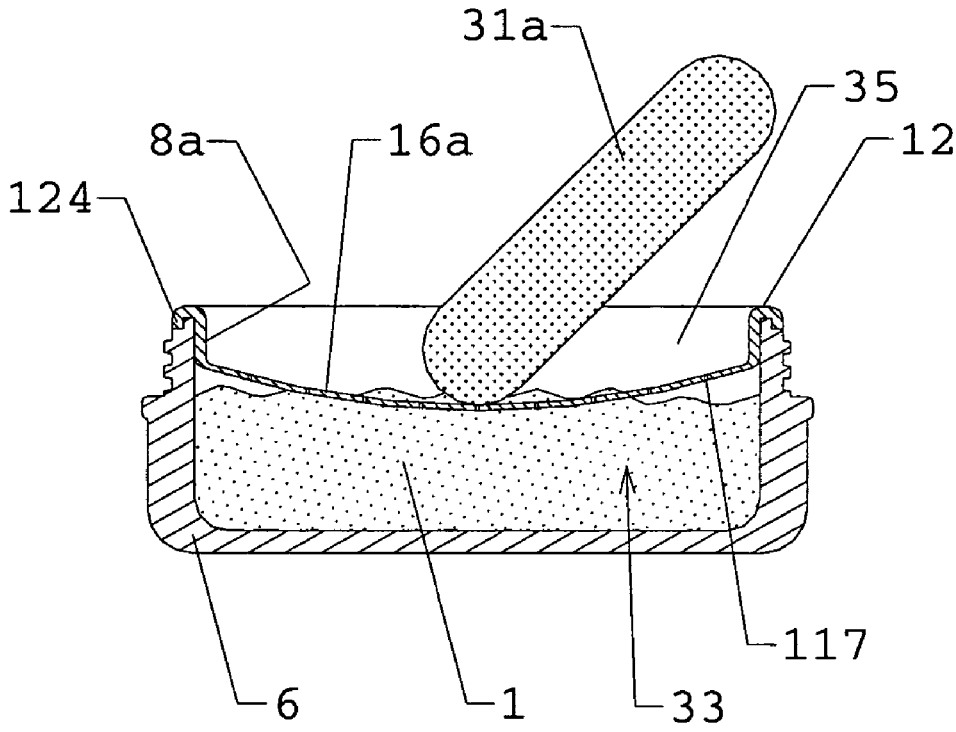
FIG. 2 is a front cross sectional view of the container for make-up powder according to an example of the present invention when the make-up material is made to adheres to the application member.
Figure 3:
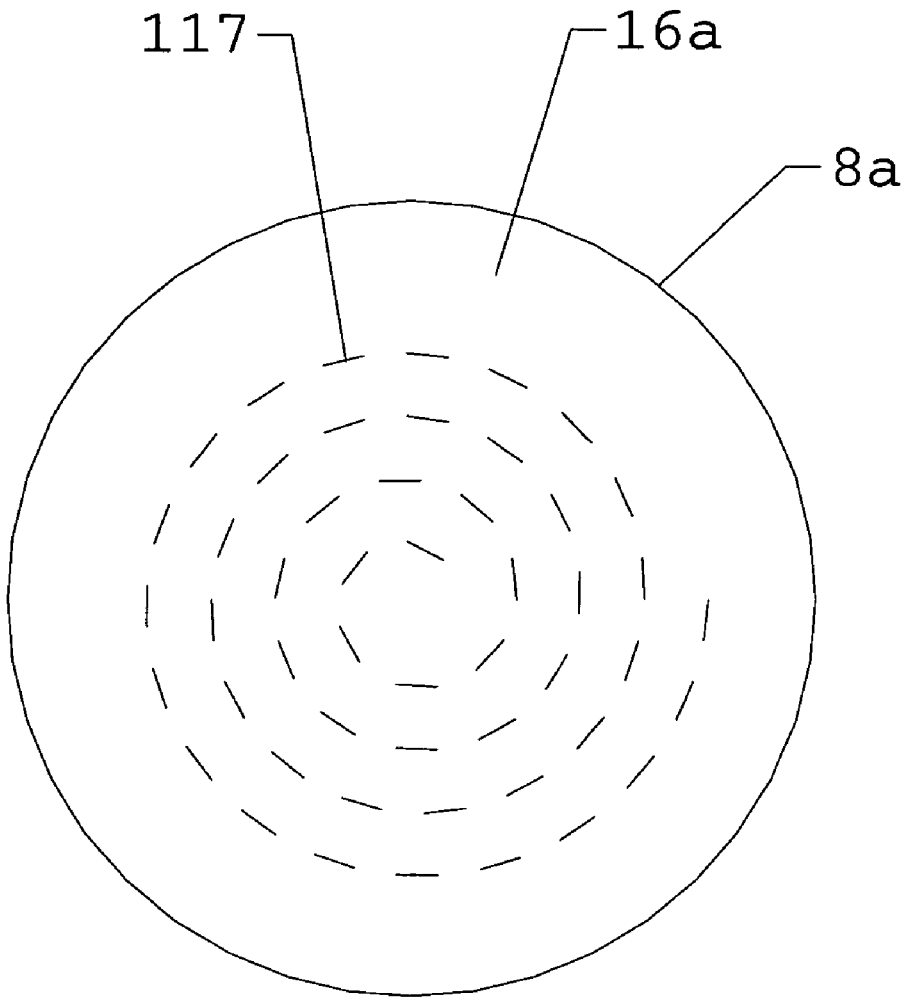
FIG. 3 is a plane view of the partition portion of the intermediate lid according to an example of the present invention.
Figure 4:
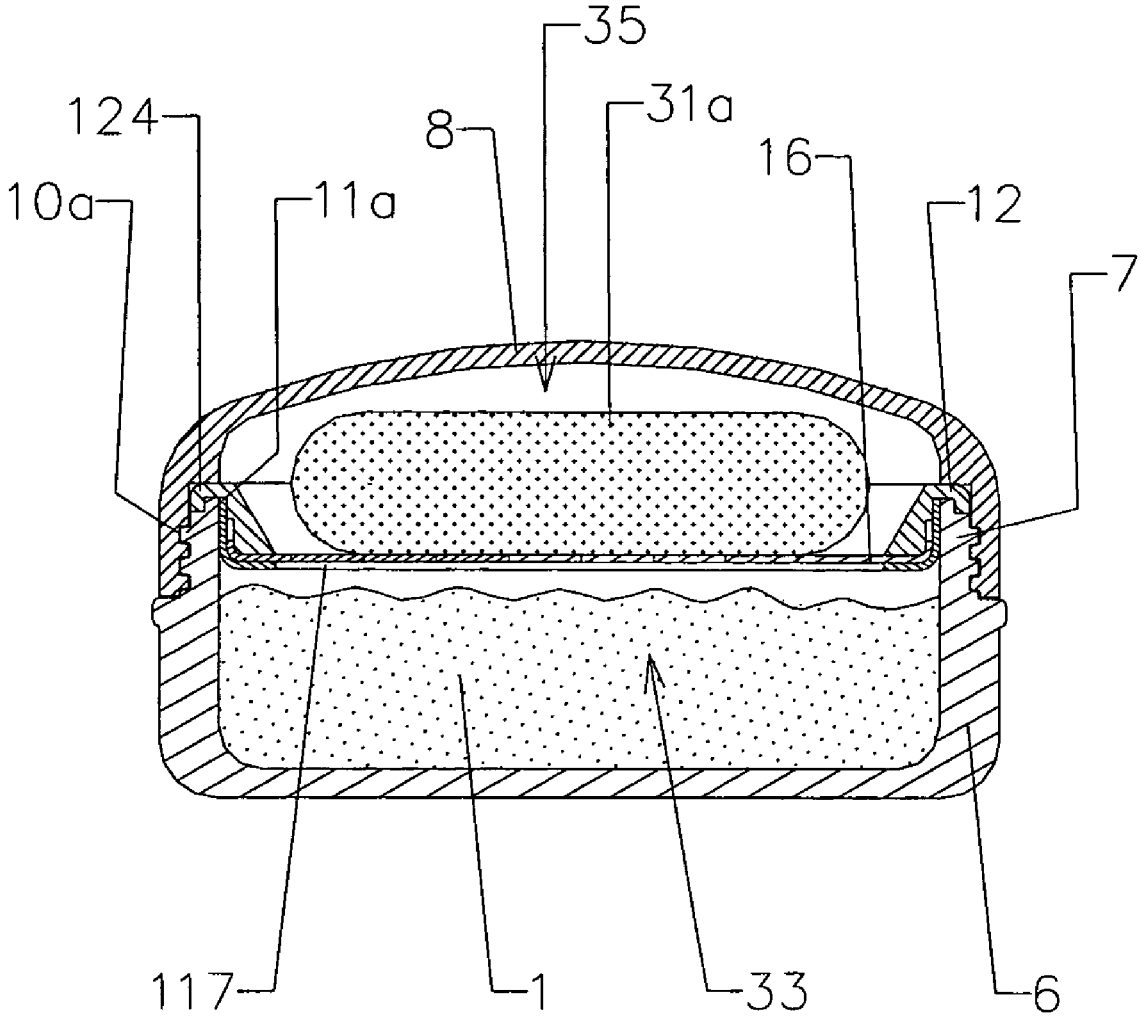
FIG. 4 is a front cross sectional view of the container for make-up powder according to an example of the present invention, wherein the intermediate lid is constituted by multiple parts.
Figure 5:
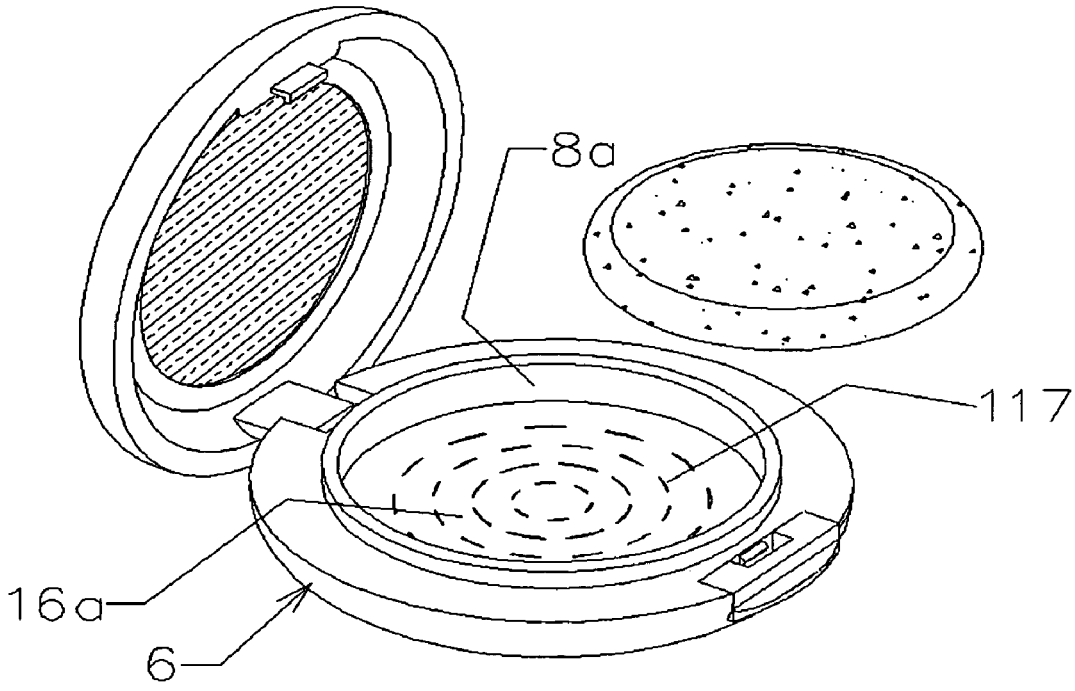
FIG. 5 is a perspective view of the container for make-up powder of compact type according to an example of the present invention.

Next, an example of carrying out the present invention will be explained. In the example of the present invention, as a container for storing make-up powder, a bottle type container which is closed up tightly with a screw cap will be explained. However, the example does not limit the present invention, and needless to say, can be applied to a compact case type which uses a hinge to connect a lid and a container, or a type which press fits a cap to a container.

The container 6 storing the make-up powder 1 has a closed bottom and an open top, and is provided with a neck portion 7 having an upper outer periphery to which a cap 8 is fitted. This neck portion 7 has an outer periphery provided with a male screw 11*a* which is engaged with a female screw 10*a* provided on an inner periphery of the cap 8. At the opening of the container 6, the intermediate lid 8*a* is fitted, and the make-up material-storing compartment 33 storing the make-up powder 1 such as white powder or powder foundation is constituted under the intermediate lid 8*a*. Further, above the intermediate lid 8*a*, the application member-storing compartment 35 is constituted between the inner wall of the cap 8 and the intermediate lid 8*a*, on which an application member 31*a* such as a puff having a long pile called a powder puff is placed.

The intermediate lid 8*a* is formed with an elastic material such as silicon rubber, and its outer periphery has a fixing portion 124 which is fitted and fixed to the neck portion 7 of the container 6. This fixing portion 124 has an upper surface serves as a gasket 12 to seal the interior of the container 6 by contacting a sealing surface of the cap 8 when the cap 8 is engaged. The intermediate lid 8*a* has the partition portion 16*a* where the opening at a mouth portion of the container 6 is closed. By the partition portion 16*a*, the make-up material-storing compartment 33 thereabove and the application member-storing compartment thereunder are divided. This partition portion 16*a* is provided with the small cuts 117 piercing through to the undersurface. These small cuts 117 are arranged discontinuously in machine-sewing like trails in concentric circles or swirls from the center of the partition portion 16*a*.

These small cuts 117 are closed when not in use, or under a condition where no load is applied during transportation, for example, and configured to completely isolate the make-up material-storing compartment 33 and the application member-storing compartment 35. When the partition portion 16*a* of the intermediate lid 8*a* is pushed by the application member 31*a* in order to perform adhesion of the make-up material 1 to the application member 31, the partition portion 16*a* is extended, thereby opening the small cuts 117, so that the make-up material 1 within the make-up material-storing compartment 33 can adhere to the application member 31*a* through the small cuts 117.

In the present invention, because of the above structures, when not in use, the small cuts 117 of the partition portion 16*a* of the intermediate lid 8*a* are closed, thereby preventing unintentional entry of the make-up material 1 into the application member-storing compartment 35. When in use, by stretching the partition portion 16*a* with the application member 31*a* or the like, the small cuts 117 opens. Under this condition, when pushing the application member 31*a* against the make-up material 1, the application member 31*a* can make the make-up material 1 adhere thereto. Alternatively, if the container 6 is turned over under a condition where the partition portion 16*a* is stretched with the application member 31*a*, the make-up material 1 falls on the application member 31*a* through the small cuts 117, thereby making the make-up material 1 adhere to the application member 31*a*.

In the example of the present invention, although the structure where the intermediate lid 8*a* is entirely formed with an elastic material was explained, it is not required as long as at least a part of the partition portion 16*a* is made of an elastic material. For example, it is possible that the fixing portion 124 is made of a hard resin so as to securely fix the intermediate lid 8*a*, whereas the partition portion 16*a* is made of an elastic material. Further, it is possible that the partition portion 16*a* has a two-layer structure where an elastic mesh generally used is disposed above an elastic sheet having small cuts 117 of the present invention disposed underneath.

As to this elastic material, a material such as urethane rubber which is elastic but easily cracked is not suitable in consideration of the stretching of the small cuts 117, and a material such as silicon rubber which is elastic and is not easily cracked is suitable. Further, as to the thickness of the partition portion 16*a*, in order to prevent the small cuts from opening when the partition portion 16*a* is shaken due to vibration or when the container 6 is upside down and the weight of the make-up material 1 is exerted on the partition portion 16*a*, a certain thickness is required; particularly, a thickness of approximately 0.3 mm to 3.0 mm is necessary. Additionally, when the partition portion 16*a* has a two-layer structure, because the elastic sheet is protected by the elastic mesh, even if the thickness of the elastic sheet is thinner than a single layer structure, the same effect can be obtained.

As to the arrangement of the small cuts 117 of the partition portion 16*a* of the intermediate lid 8*a*, in the example, they are arranged in concentric circles or swirls from the center of the partition portion 16*a*. However, as long as the arrangement is in a direction crossing a direction of extension of the partition portion 16*a* under a normal use condition, the position and the number of the small cuts 117 can freely be selected.

As described above, in the present invention, at least a part of the partition portion 16*a* of the intermediate lid 8*a* is constituted by an elastic material; a numerous number of the small cuts 117 are formed in the partition portion 16*a*; when no load is applied (not in use), the small cuts 117 are closed, thereby closing the make-up material compartment 33; when a load is applied (in use), the partition portion 16*a* is stretched, thereby opening the small cuts 117 and enabling the make-up powder 1 to pass through the small cuts 117 and to be usable; and whereby the make-up powder 1 can adhere to the application member 31*a*. Because of the above, unintentional entry of the make-up material 1 into the application member-storing compartment 35 is completely prevented. Thus, scattering of the make-up material 1 imprudently entered in the application member-storing compartment 35 does not occur by air flow caused by opening and closing the cap, for example.

Further, because it can be carried out to replace an intermediate lid 8*a* with one made of an elastic material so as to form the small cuts 117 in the partition portion 16*a* of the intermediate lid 8*a*, an existing container itself can be used as the container 6, without complication or a cost increase.

The invention claimed is:

1. A container for make-up powder having a structure wherein a make-up material-storing compartment storing make-up powder such as white powder or powder foundation is constituted under an intermediate lid which is engaged with a container, said container being characterized in that at least a part of a two-layer partition portion of said intermediate lid constituting the make-up material-storing compartment is formed with an elastic material, numerous small cuts which are arranged discontinuously and formed in the two-layer partition portion vertically, thereby enabling make-up powder to pass through the small cuts opened by extending the two-layer partition portion, wherein the two-layer partition portion comprises an elastic sheet layer and an elastic mesh layer disposed above the elastic sheet layer.

* * * * *